US006338230B1

(12) United States Patent
Davey

(10) Patent No.: US 6,338,230 B1
(45) Date of Patent: Jan. 15, 2002

(54) SIMULATED SHAKE SHINGLE

(76) Inventor: John F. Davey, 6503 SW. Orchid St., Portland, OR (US) 97223

( * ) Notice: Subject to any disclaimer, the term of this patent is extended or adjusted under 35 U.S.C. 154(b) by 0 days.

(21) Appl. No.: 09/426,448

(22) Filed: Oct. 25, 1999

(51) Int. Cl.[7] ..... E04D 1/00
(52) U.S. Cl. ..... 52/518
(58) Field of Search ..... 52/518, 560, 313, 52/535, 537, 522

(56) References Cited

U.S. PATENT DOCUMENTS 1,558,005 A * 10/1925 Finley
1,759,901 A * 5/1930 Harshberger
2,076,989 A * 4/1937 Harpham
2,142,181 A * 1/1939 Croce
2,168,217 A * 8/1939 Kirschbraun
2,895,181 A * 7/1959 Hope et al.
2,935,768 A * 5/1960 Roupe
3,830,687 A 8/1974 Re et al.
3,899,855 A 8/1975 Gadsby
3,912,800 A 10/1975 Edlin et al.
3,919,356 A 11/1975 Boyer
4,647,486 A 3/1987 Ali
4,656,667 A 4/1987 Blake
5,053,274 A 10/1991 Jonas
5,072,563 A * 12/1991 Menegoli
5,210,989 A * 5/1993 Jakel
5,295,339 A 3/1994 Manner
5,492,562 A 2/1996 Pettinato
5,635,125 A 6/1997 Ternes et al.

* cited by examiner

*Primary Examiner*—Milton Nelson, Jr.
(74) *Attorney, Agent, or Firm*—Dale J. Ream

(57) ABSTRACT

A simulated wood shake shingle comprises a generally rectangular bottom plate having forward and rearward ends and first and second side edges intermediate the forward and rearward edges. The shingle includes a generally rectangular top plate having forward and rearward ends and first and second side edges intermediate the forward and rearward ends. The top plate is attached to the bottom plate and is forwardly and transversely offset therefrom. In addition, the top plate is rearwardly tapered. The top plate includes a layer of corrugated material for dissipating or resisting impact forces thereon.

19 Claims, 7 Drawing Sheets

SIMULATED SHAKE SHINGLE

BACKGROUND OF THE INVENTION

This invention relates generally to roofing materials and, more particularly, to a more durable simulated shake shingle having a layer of corrugated material between acrylonitrile butadiene polymer surfaces.

Wooden shake shingles have been used for roofing houses for many years. In fact, there is a growing shortage of the best wood for making wood shake shingles. Consequently, the wood presently being used is of inferior quality and yields inherent flaws in the final product such as faster deterioration, discoloration, and mold and fungus buildup. An inherent disadvantage with wood shake shingles is an increased fire hazard in comparison with other roofing materials. In addition, nearly all types of presently used roofing materials, including wood shake shingles, can be damaged significantly by severe weather such as wind or hail.

Simulated wood shake shingles have been proposed in the art as a suitable option to genuine wood shake shingles, such as those proposed in U.S. Pat. Nos. 5,295,339 and 3,899,855. The shingles proposed in these patents, however, still do not overcome all of the disadvantageous described above.

Therefore, it is desirable to have a simulated wood shake shingle which is resistant to damage from severe weather elements. It is also desirable to have a simulated wood shake shingle which does not deteriorate as a result of extreme temperature changes.

SUMMARY OF THE INVENTION

Accordingly, a simulated wood shake shingle according to the preferred embodiment of the present invention includes a generally rectangular plate having forward, rearward, and side edges. A generally rectangular top plate also includes forward, rearward, and side edges. The top plate is attached to and partially overlaps the bottom plate. In the standard shingle, the top plate is forwardly and transversely offset from the bottom plate such that the top plate overlaps the side and rearward portions of the bottom plates of adjacent shingles in use. Edge and starter shingles are constructed in a manner substantially similar to the standard shingle except that the top plate is not transversely offset, not forwardly offset, or both. The top and bottom plates are formed of an acrylonitrile butadiene polymer having rubber-like characteristics which resist deterioration that normally results from the repeated freezing and thawing of other materials.

Each top plate includes one or more layers of a corrugated material. The corrugated material may be a series of radially folded elastic steel disks having a rigid filler material therein. This configuration is particularly suited to absorb or dissipate strong impact forces, such as those caused by hail or falling debris. Alternatively, the corrugated material may include several layers of material having specifically varied pitches for distributing impact forces amongst the several layers. This configuration is particularly useful to withstand forces such as strong wind by enhancing the strength and rigidity of the shake shingle.

Therefore, it is an object of this invention to provide a simulated wood shake shingle which is durable against strong impacts, such as falling debris or hail.

Another object of this invention is to provide a simulated wood shake shingle, as aforesaid, which minimizes contraction and expansion due to extreme fluctuations in ambient air temperature.

Still another object of this invention is to provide a simulated wood shake shingle, as aforesaid, which precludes precipitation from contacting the roof surface.

Yet another object of this invention is to provide a simulated wood shake shingle, as aforesaid, that is lightweight.

A further object of this invention is to provide a simulated wood shake shingle, as aforesaid, which can inhibit the formation of mildew, fungi, and algae.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
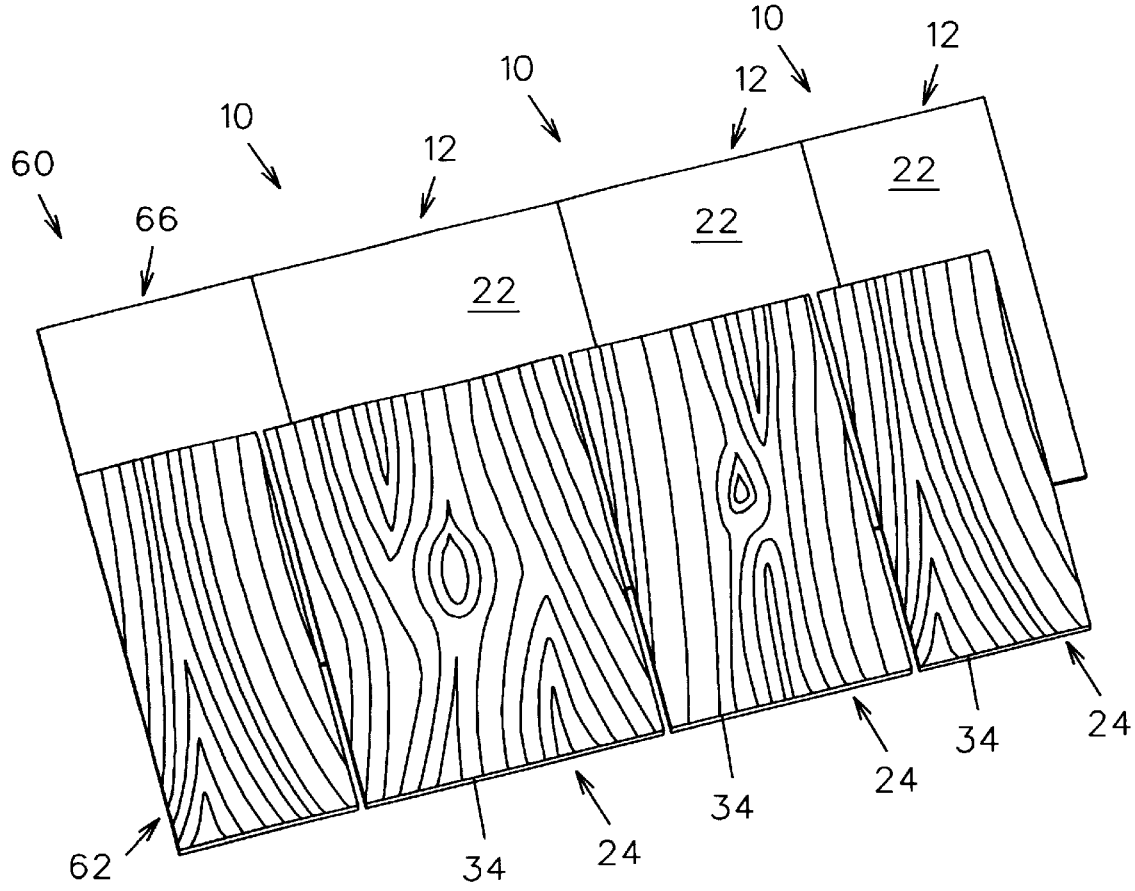
FIG. 1 is a perspective view of four simulated wood shake shingles according to the present invention.
Figure 8:
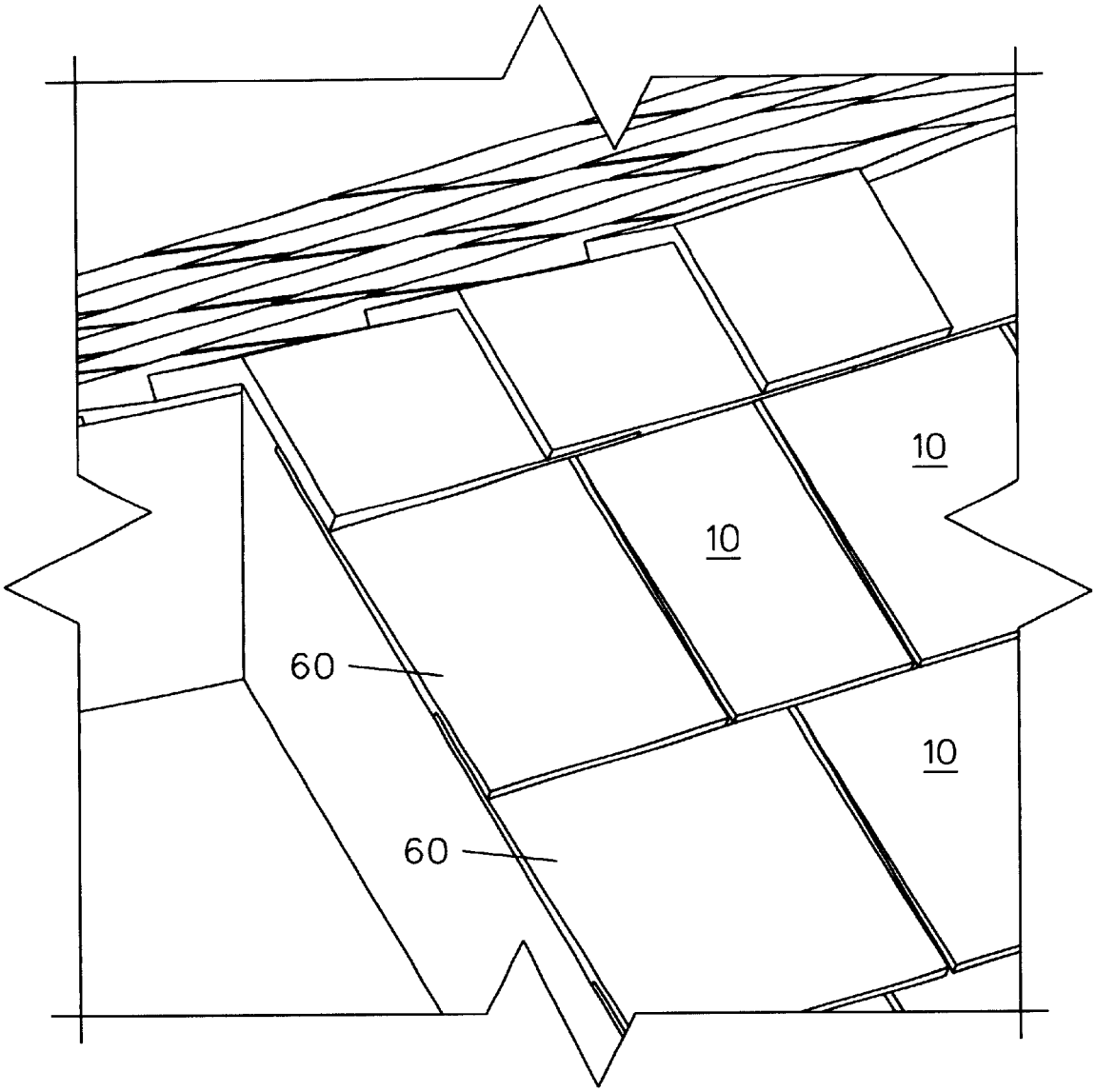
FIG. 8 is a perspective view of the simulated wood shake shingles according to the present invention positioned on a roof surface.

Turning more particularly to the drawings, FIG. 1 shows four simulated wood shake shingles in side by side engagement according to the preferred embodiment of the present invention. FIG. 8 shows a portion of a roof surface covered with the shingles. Each type of shingle will be further described below.

Figure 2:
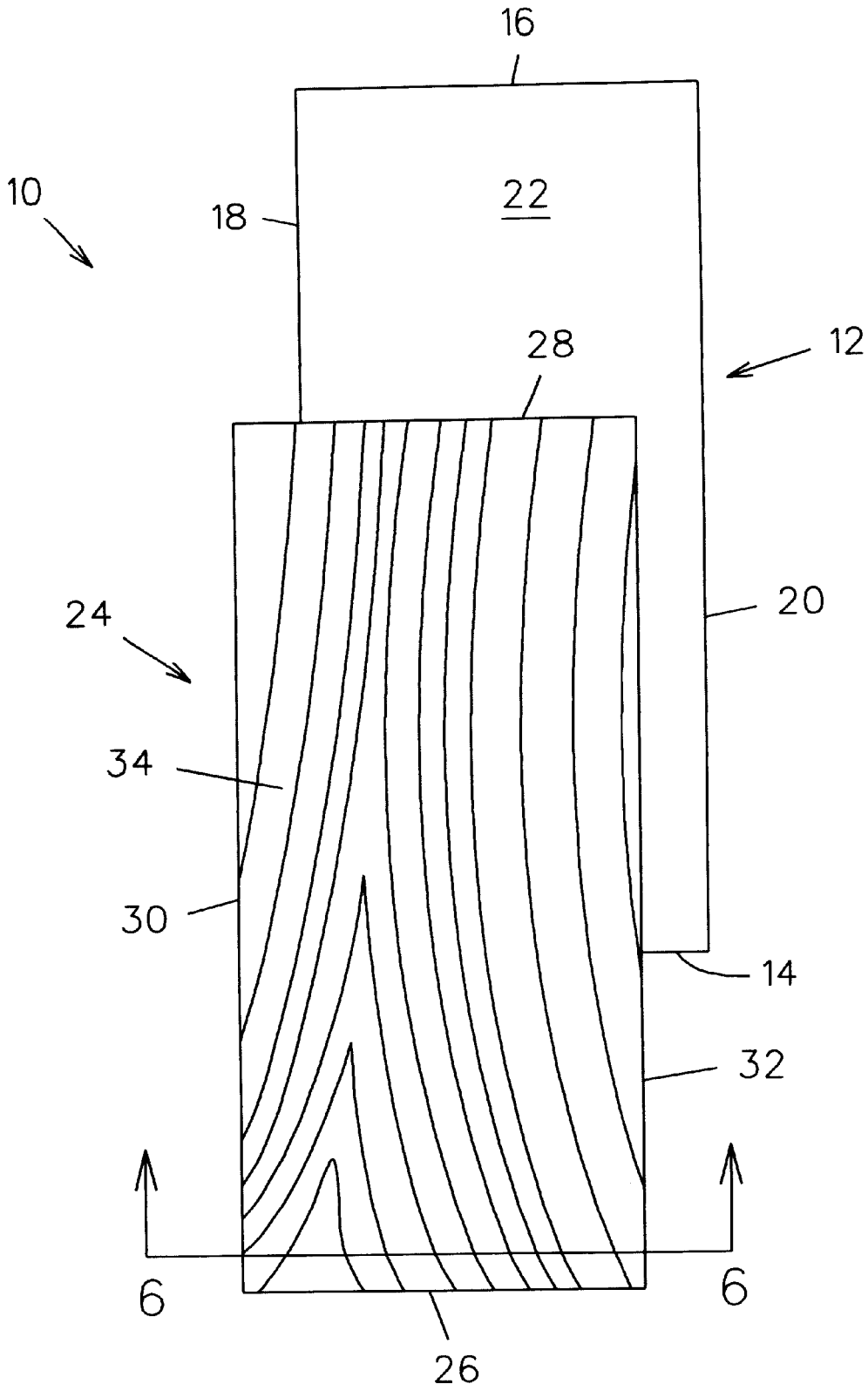
FIG. 2 is a top view of a standard simulated wood shake shingle.
Figure 4:
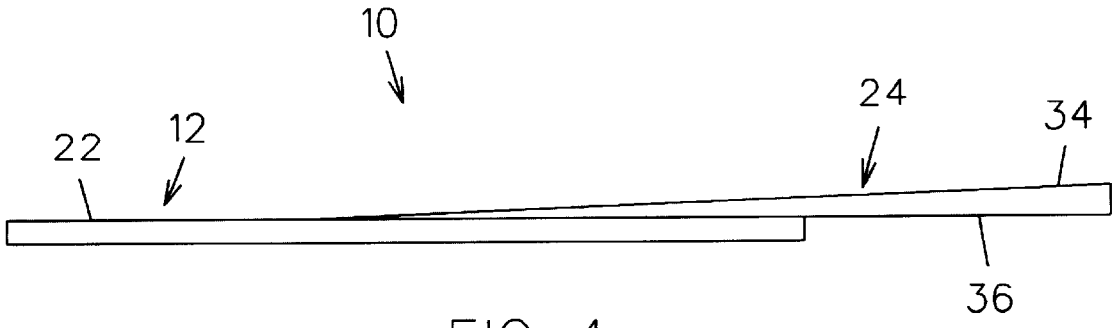
FIG. 4 is a left side view of a standard simulated wood shake shingle as in FIG. 2.

As shown more particularly in FIGS. 2 and 4, a standard shingle 10 includes a generally rectangular bottom plate 12 having front 14 and rear 16 edges with spaced apart first 18 and second 20 side. edges intermediate the front 14 and rear 16 edges. The standard shingle 10 also includes a generally rectangular top plate 24 having front 26 and rear 28 edges with spaced apart first 30 and second 32 side edges intermediate the front 26 and rear 28 edges. The top plate 24 includes an upper surface 34 that is decreasingly tapered between front 26 and rear edges 28 thereof and a lower surface 36 fixedly attached to an upper surface 22 of the bottom plate 12. The top plate 24 of the standard shingle 10 partially overlaps and is forwardly and transversely offset from the bottom plate 12. More particularly, the front edge 26 of the top plate 24 extends forwardly beyond the front edge 14 of the bottom plate 12, and the first side edge 30 of the top plate 24 is displaced outwardly from the first side edge 18 of the bottom plate 12 (FIG. 2). In addition, this forward and transverse offset results in the rear 28 and second side 32 edges of the top plate 24 being inwardly spaced apart from the rear 16 and second side 20 edges, respectively, of the bottom plate 12. The width of each standard shingle 10 may be variable to ultimately provide a random wood shake shingle appearance to a roof surface.

The bottom 12 and top 24 plates are constructed of an acrylonitrile butadiene polymer although other engineered grades of plastic may also be used, such as high density polyethylene (HDPE), low density polyethylene (LDPE), polypropylene (PP), polyethylene terephthalate (PET), polystyrene (PS), polyvinyl chloride (PVC), acrylonitrile styrene (ABS), nitrile rubber (NBR), or polyphtalate carbonate compounds of the Lexan family. The preferred polymer is a durable material having rubber-like characteristics, including the ability to absorb impacts and to resist cracking and splitting caused by contraction and expansion that is typical when materials are subjected to extreme temperature fluctuations. Biocides for inhibiting mildew, fungi, and algae buildup are also added to the plate material during manufacture. The upper surface 34 of the top plate 24 is textured to simulate the natural look of a wood shake shingle.

Figure 6:
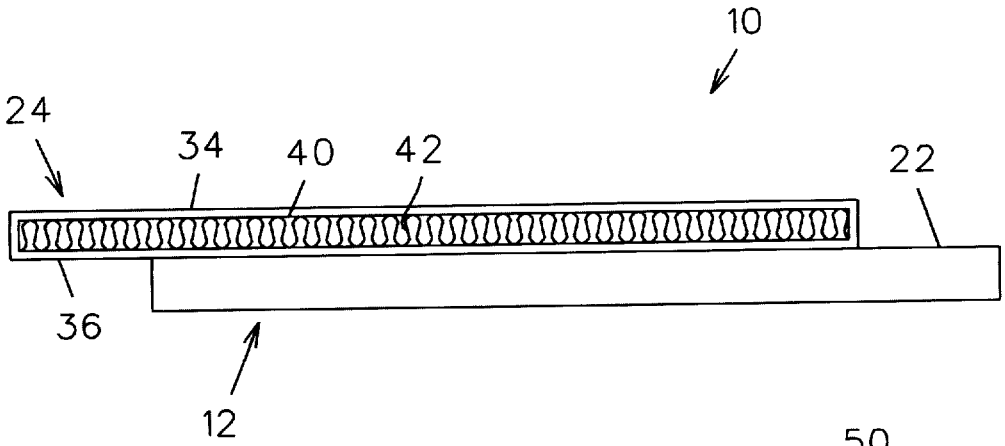
FIG. 6 is a sectional view of a simulated wood shake shingle taken along line 6—6 of FIG. 2.
Figure 7:
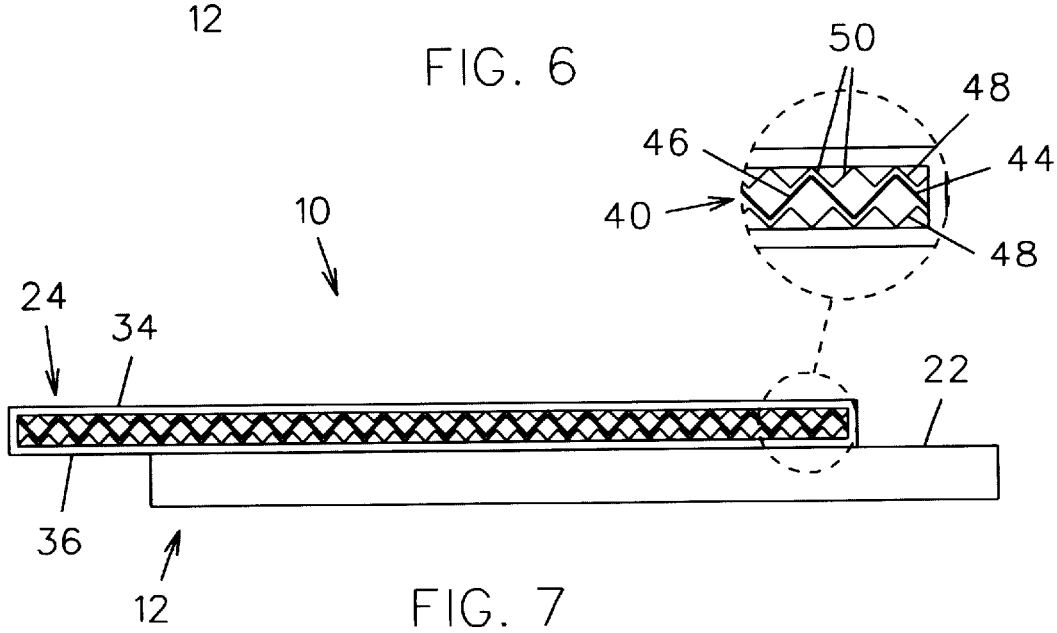
FIG. 7 is an alternative embodiment of the simulated wood shake shingle of FIG. 6.

The top plate 24 includes a layer of lightweight corrugated material 40 between upper 34 and lower 36 surfaces thereof (FIG. 6). The corrugated layer 40 is tapered according to the configuration of the top plate 24. The corrugated layer 40 includes a plurality of elastic corrugated steel disks 42 in the form of radial folds. Each fold forms a cavity filled with a rigid material. The disks 42 and filler material are compressed upon impact for dissipating impact energy. Alternatively, the corrugated layer 40 may include multiple layers for increasing the rigidity of the top plate 24 (FIG. 7). In this embodiment, a central layer 44 has a maximum crest pitch and is surrounded by two additional layers 48, each having a pitch that is half the maximum pitch. Thus, when the top plate 24 is bent or impacted, a corresponding rib 46 of the central layer 44 bears against two ribs 50 of the adjacent layer 48. The stress of the affected rib 46 is distributed between that rib 46 and the two ribs 50 of the adjacent layer 48. This configuration increases the strength and rigidity of the top plate 24.

Figure 3:
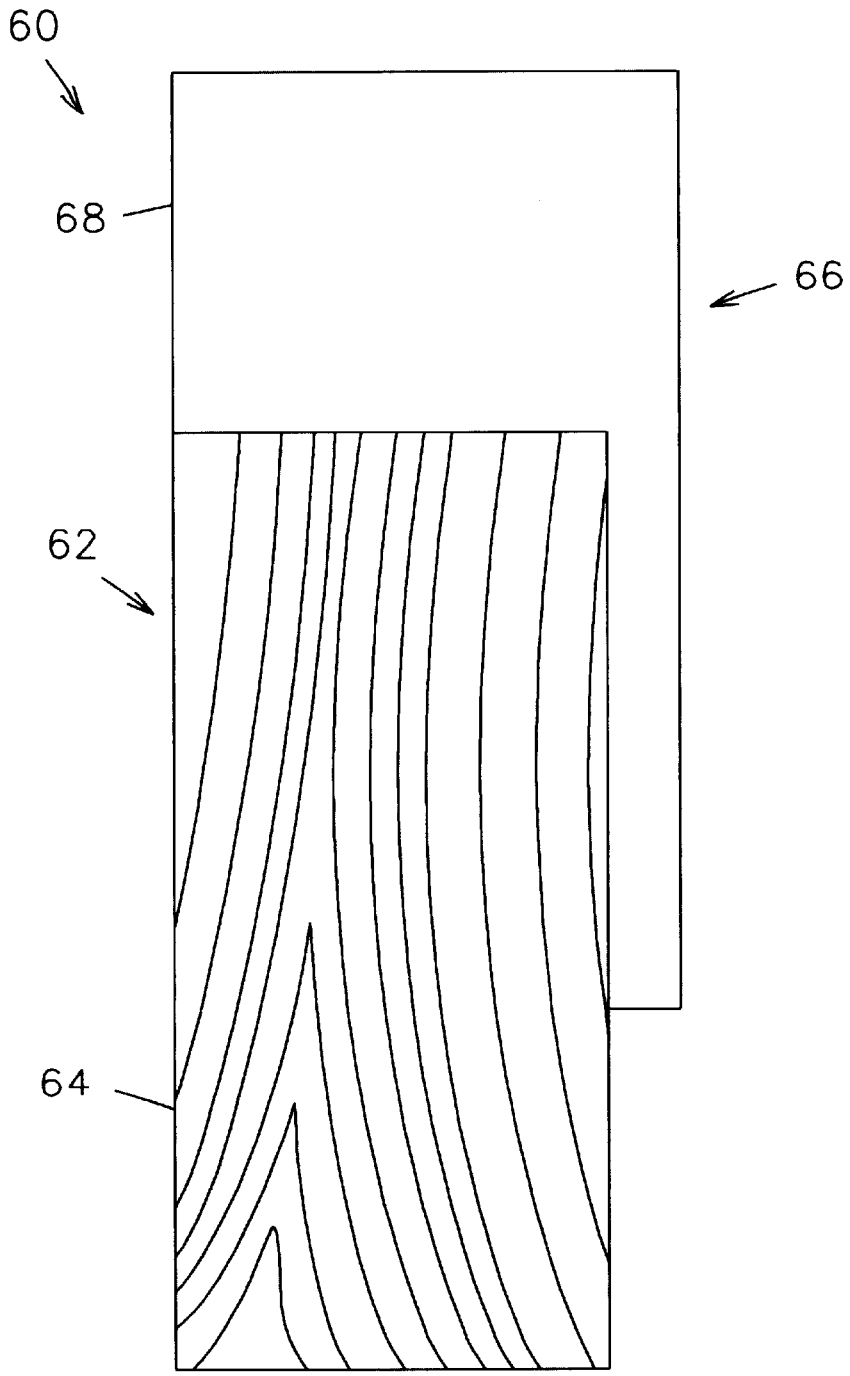
FIG. 3 is a top view of an edge simulated wood shake shingle.
Figure 5:
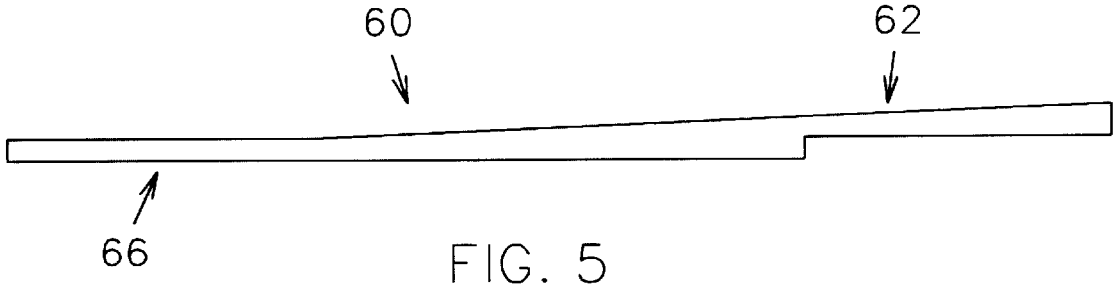
FIG. 5 is a left side view of an edge simulated wood shake shingle as in FIG. 3.

The present invention further includes an edge shingle 60 (FIGS. 3 and 5). An edge shingle 60 is substantially similar in construction to the standard shingle 10 except that the first side edge 64 of the top plate 62 is aligned with the first side edge 68 of the bottom plate 66. Thus, the first side edge 68 of the top plate 62 is not transversely offset from the bottom plate 66 and does not extend beyond the edge of the roof surface.

Figure 9:
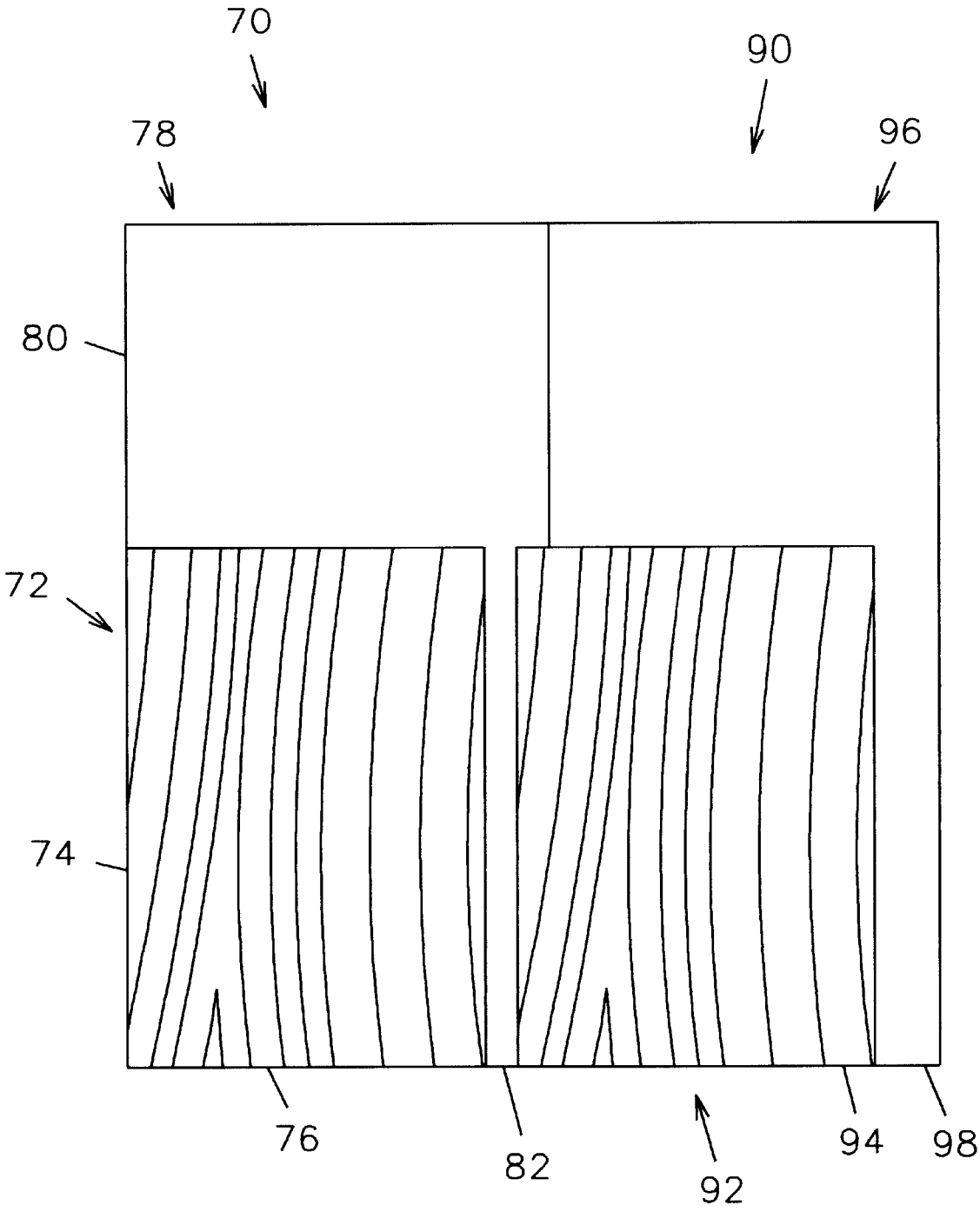
FIG. 9 is a top view of a starter simulated wood shake shingle coupled to an edge simulated wood shake shingle.

The present invention also includes starter shingles. A starter edge shingle 70 includes a construction substantially similar to that of the standard shingle 10 except that both the first side edge 74 and front edge 76 of the top plate 72 are aligned with the first side edge 80 and front edge 82 of the bottom plate 78 (FIG. 9). In addition, a standard starter shingle 90 has a construction substantially similar to a standard shingle 10 except that the front edge 94 of the top plate 92 is aligned with the front edge 98 of the bottom plate 96. Therefore, the starter shingles 70, 90 are designed to eliminate the need to cut off portions of shingles which would otherwise extend beyond the side or front edges of a roof surface. It should be appreciated that cutting these shingles would expose the corrugated layer 40 to weather elements and be unsightly.

In use, a starter edge shingle 70 is positioned in the lower, left-hand corner of the roof surface to be shingled. Known roofing fasteners may be used to attach the shingle to the roof, such as nails or staples. A standard starter shingle 90 is then positioned immediately adjacent to the starter edge shingle 70. When the bottom plates 78, 96 of the shingles are placed in side to side relation, the top plate 92 of the standard starter shingle 90 overlaps the seam therebetween. Another standard starter shingle 90 is then placed adjacent to the preceding starter shingle, and so on.

A standard edge shingle 60 is positioned above the starter edge shingle 70. When the front edge of the bottom plate 66 of the standard edge shingle 60 abuts the rear edge of the bottom plate 78 of the starter edge shingle 70, the top plate 62 of the standard edge shingle 60 overlaps the seam therebetween to provide a weather barrier. In like manner, a standard shingle 10 is positioned adjacent the standard edge shingle 60 and above a standard starter shingle 90, and so on. It is understood that standard shingles 10 of varying widths can be used regardless of the width of a preceding shingle or a shingle in a previous row.

Accordingly, it can be seen that the simulated wood shake shingle according to the present invention provides a lightweight, durable, and easy to use alternative to genuine wood shake shingles.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A simulated shake shingle, comprising:

a generally rectangular bottom plate having spaced apart first and second side edges and a bottom surface adapted for flush engagement with a roof surface;

a generally rectangular top plate having first and second side edges, said top plate attached to said bottom plate, said top plate further comprising:

an upper surface;

a lower surface; and a layer of corrugated material between said upper and lower surfaces.

2. A simulated shake shingle as in claim 1 wherein said top and bottom plates are formed of acrylonitrile butadiene such that contraction or expansion of said shingle as a result of temperature variations is reduced.

3. A simulated shake shingle as in claim 1 wherein said first side edge of said top plate is outwardly displaced from said first side edge of said bottom plate, and said second side edge of said top plate is inwardly displaced from said second side edge of said bottom plate.

4. A simulated shake shingle as in claim 1 wherein said upper surface of said top plate is textured to simulate a natural wood shake shingle.

5. A simulated shake shingle as in claim 1 wherein said layer of corrugated material comprises:

a central layer of corrugated material having a plurality of ribs, each rib having a maximum crest pitch;

at least one secondary layer of corrugated material overlying said central layer and having a plurality of ribs, each rib of said secondary layer having a crest pitch that is about one-half the maximum crest pitch, whereby forces exerted against said rib of said central layer are distributed between said rib of said central layer and two of said ribs of said secondary layer so as to provide increased strength to said top plate.

6. A simulated shake shingle as in claim 1 wherein said layer of corrugated material comprises a series of elastic corrugated steel disks, each disk being radially folded to form a cavity filled with a rigid material, whereby said disks and filler material are compressed by impact forces for dampening said impact forces.

7. A simulated shake shingle as in claim 1, wherein said top plate partially overlaps said bottom plate and is forwardly and transversely offset from said bottom plate.

8. A simulated shake shingle, comprising:

a generally rectangular bottom plate having forward and rearward ends and first and second side edges intermediate said forward and rearward ends;

a generally rectangular top plate having forward and rearward ends and first and second side edges intermediate said forward and rearward ends, said top plate attached to said bottom plate and rearwardly tapered, said rearward end of said top plate being forwardly spaced apart from said rearward end of said bottom plate;

wherein said top and bottom plate s are formed of acrylonitrile butadience for reducing the contraction and expansion thereof upon extreme variations in ambient air temperature; and means for resisting impact forces exerted upon said top plate.

9. A simulated shake shingle as in claim 8 wherein:

said first side edge of said top plate is aligned with said first side edge of said bottom plate;

said second side edge of said top plate is inwardly spaced apart from said second side edge of said bottom plate; and said forward end of said top plate is aligned with said forward end of said bottom plate.

10. A simulated shake shingle as in claim 8 wherein:

said first side edge of said top plate is aligned with said first side edge of said bottom plate;

said second side edge of said top plate is inwardly spaced apart from said second side edge of said bottom plate; and said forward end of said top plate is forwardly offset from said forward end of said bottom plate.

11. A simulated shake shingle as in claim 8, wherein said top plate is transversely offset from said bottom plate and said forward end of said top plate is aligned with said forward end of said bottom plate.

12. A simulated shake shingle as in claim 8 wherein said top plate is transversely and forwardly offset from said bottom plate.

13. A simulated shake shingle as in claim 8 wherein said top plate includes a textured top surface indicative of a natural wood shake shingle.

14. A simulated shake shingle as in claim 8 wherein said resisting means comprises:

a central layer of corrugated material having a plurality of ribs, each rib having a maximum crest pitch;

at least one secondary layer of corrugated material overlying said central layer and having a plurality of ribs, each rib of said secondary layer having a crest pitch that is one-half the maximum crest pitch, whereby forces exerted against said rib of said central layer are distributed between said rib of said central layer and two of said ribs of said secondary layer so as to provide increased strength to said top plate.

15. A simulated shake shingle as in claim 8 wherein said resisting means includes a series of elastic corrugated steel disks, each said disk being radially folded to form a cavity filled with a rigid material, whereby said disks and filler material are compressed by impact forces so as to dampen the effect thereof.

16. A simulated shake shingle, comprising:

a generally rectangular panel having an upper surface and a lower surface and defining an interior space between said upper and lower surfaces, said upper and lower surfaces formed of an acrylonitrile but,diene polymer; and a corrugated material positioned within said interior space for enhancing the rigidity of said panel.

17. A simulated shake shingle as in claim 16 wherein said upper surface is textured to resemble a natural wood shake shingle.

18. A simulated shake shingle as in claim 16 wherein said corrugated material includes a series of elastic corrugated steel disks, each disk being radially folded to form a cavity filled with a rigid material, whereby said disks and filler material are compressed by impact forces so as to dampen said impact forces.

19. A simulated shake shingle as in claim 16 wherein said corrugated material comprises:

a central layer of corrugated material having a plurality of ribs, each rib having a maximum crest pitch;

at least one secondary layer of corrugated material overlying said central layer and having a plurality of ribs, each rib of said secondary layer having a crest pitch that is about one-half the maximum crest pitch, whereby forces exerted against said rib of said central layer are distributed between said rib of said central layer and two of said ribs of said secondary layer so as to provide increased strength to said top panel.

* * * * *